US007097348B2

(12) United States Patent
Miller

(10) Patent No.: US 7,097,348 B2
(45) Date of Patent: Aug. 29, 2006

(54) METHODS AND APPARATUSES FOR MIXING COSMETIC PREPARATIONS AT A POINT OF SALE

(75) Inventor: William A. Miller, Buffalo Grove, IL (US)

(73) Assignee: Fluid Management, Inc., Wheeling, IL (US)

( * ) Notice: Subject to any disclaimer, the term of this patent is extended or adjusted under 35 U.S.C. 154(b) by 40 days.

(21) Appl. No.: 10/626,323

(22) Filed: Jul. 24, 2003

(65) Prior Publication Data

US 2005/0018535 A1 Jan. 27, 2005

(51) Int. Cl.
*B01F 3/10* (2006.01)
*B01F 9/00* (2006.01)

(52) U.S. Cl. ..... 366/217; 366/348

(58) Field of Classification Search ..... 366/217, 366/348, 349

See application file for complete search history.

(56) References Cited

U.S. PATENT DOCUMENTS 3,880,408 A * 4/1975 Karjalainen ..... 366/217
4,813,412 A * 3/1989 Yamazaki et al. ..... 606/46
4,871,262 A * 10/1989 Krauss et al. ..... 366/160.3
5,163,010 A * 11/1992 Klein et al. ..... 366/160.1
5,622,692 A * 4/1997 Rigg et al. ..... 366/160.1
5,785,960 A * 7/1998 Rigg et al. ..... 366/160.1
5,903,465 A 5/1999 Brown
6,202,895 B1 * 3/2001 Fox ..... 222/144
6,412,658 B1 7/2002 Bartholomew et al.
D461,080 S 8/2002 Bartholomew et al.
D465,810 S 11/2002 Bartholomew et al.
6,510,366 B1 1/2003 Murray et al.
6,615,881 B1 9/2003 Bartholomew et al.
6,622,064 B1 9/2003 Bartholomew et al.
D485,310 S 1/2004 Bartholomew et al.
6,672,341 B1 1/2004 Bartholomew et al.
6,767,126 B1 * 7/2004 Miller ..... 366/217
2001/0047309 A1 11/2001 Bartholomew et al.
2002/0010528 A1 1/2002 Bartholomew et al.
2002/0131985 A1 * 9/2002 Shana'a et al. ..... 424/401
2002/0136700 A1 * 9/2002 Margosiak et al. ..... 424/70.21
2002/0179639 A1 12/2002 Bartholomew et al.
2003/0060925 A1 3/2003 Bartholomew et al.
2003/0062379 A1 4/2003 Bartholomew et al.
2003/0090176 A1 5/2003 Bartholomew et al.
2003/0107949 A1 6/2003 Huckby et al.

(Continued)

FOREIGN PATENT DOCUMENTS

EP 1123732 A2 8/2001

(Continued)

OTHER PUBLICATIONS

International Search Report of PCT/US2004/022741 dated Dec. 16, 2004 (7 pages).

(Continued)

*Primary Examiner*—Tony G. Soohoo

(57) ABSTRACT

A method of mixing customized cosmetic products at a point of sale is disclosed. The method includes a suspension free of colorant to a container, adding one or more suspensions containing one or more colorants on top of the non-colorant containing suspension and adding one or more suspensions containing additional non-colorant ingredients on top of the one or more suspensions including the colorants, closing the container and mixing the suspension using a gyroscopic-type or rotary-type mixing apparatus. The container sidewall and bottom surface are coated with suspensions not containing colorant which prevents colorant materials from adhering to the sidewall and bottom portion of the container thereby providing for a more effective mixing of a customized cosmetic product at the point of purchase.

16 Claims, 5 Drawing Sheets

U.S. PATENT DOCUMENTS

2003/0230355 A1 12/2003 Bartholomew et al.

FOREIGN PATENT DOCUMENTS

| | | | |
|---|---|---|---|
| EP | 1145704 | A1 | 10/2001 |
| WO | WO 98/30189 | | 7/1998 |
| WO | WO-01-75586 | A1 | 10/2001 |
| WO | WO 02/15735 | A2 | 2/2002 |
| WO | WO-03-026458 | A2 | 4/2003 |

OTHER PUBLICATIONS

Written Opinion of the International Searching Authority of PCT/US2004/022741 dated Dec. 16, 2004 (5 pages).

* cited by examiner 35
38
41
42
11
13
33
47
34
32
31
5
43
46
10
45
44
36
39
37

METHODS AND APPARATUSES FOR MIXING COSMETIC PREPARATIONS AT A POINT OF SALE

TECHNICAL FIELD

Methods for preparing and mixing a customized cosmetic preparation at a point of sale are disclosed. More specifically, methods of preparing a customized cosmetic preparation and the subsequent mixing thereof at a point of sale are disclosed which provide for sufficient mixing of viscous ingredients in small batch amounts or in individual sale-sized containers.

DESCRIPTION OF THE RELATED ART

Cosmetic preparations that are customized at the point of sale are growing in popularity. Specifically, a number of companies in the cosmetic industry have installed various apparatuses in retail stores for dispensing the various components of a cosmetic preparation in individual containers. Often, the ingredients are dispensed based upon computer programs which utilize information relating to the customer's skin color, oiliness and other properties to determine the proper color texture and other qualities of the customized product. The ingredients are dispensed into a container and the container is sealed, mixed and sold to the customer. Thus, the customized cosmetic product is formulated and prepared at the point of sale.

Such cosmetic products contain very viscous components. Specifically, the typical ingredients of a cosmetic product include a slurry that includes talc, various viscous slurries that include colorants such as black, red and yellow and additional viscous slurries that include silicone and titanium dioxide. The mixing of these products in small batches, i.e., containers having volumes ranging from 1 to 4 fluid ounces, is problematic because of the viscous nature of the ingredients. One specific problem is the addition of the slurries containing colorants. Often, these slurries will engage a sidewall of the small container and may never be mixed properly in the final formulation as the colorant adheres to the sidewall of the container. Further, the white color of the talc and titanium dioxide slurries may also be apparent on the sidewall or bottom wall of the container even after vigorous mixing.

Therefore, there is a need for an improved process for mixing cosmetic products at a point of sale which enables the colorant, talc, titanium dioxide and silicone slurries to be evenly and thoroughly mixed into a uniform composition. Without a suitable mixing process, customers may be unwilling to pay the added cost involved in purchasing customized cosmetic products.

SUMMARY OF THE DISCLOSURE

In satisfaction of the aforenoted needs, an improved method of mixing cosmetic preparations at a point of sale is disclosed which comprises: providing a container with an open top; adding one or more base suspensions to the container; adding one or more suspensions comprising one or more additional ingredients on top of the base suspension; adding additional one or more base suspensions on top of the one or more suspensions comprising one or more additional ingredients; closing the open top of the container with a lid; and mixing the suspensions within the container by applying mechanical energy to the closed container.

In a refinement, the first adding of a base suspension further comprises coating a bottom of the container with the base suspension to prevent the one or suspensions comprising the additional ingredients from coating the bottom of the container.

In a refinement, the base suspensions may include talc, titanium dioxide and silicone combined, or individually or combinations of any two of the above three materials. The disclosed method includes adding a first base suspension prior to the adding of suspension that include other ingredients, such as colorants, to the container. By adding one or more base suspensions first, subsequent additional suspensions which may include colorants or other materials are prevented from engaging the bottom of the container where it would be difficult to obtain a proper mixing due to the viscous nature of the components of cosmetic products. Thus, the suspensions including other ingredients, such as colorants, are sandwiched between layers of base suspensions which results in improved mixability of all ingredients.

In another refinement, the one or more suspensions comprising one or more colorants comprise a first suspension comprising a red colorant, a second suspension comprising a yellow colorant and third suspension comprising a black colorant.

In another refinement, the mixing by applying mechanical energy comprises the use of a gyroscopic mixer that rotates the closed container about two different but intersecting axes.

In another refinement, the mixing by applying mechanical energy comprises using a rotary mixer that rotates the closed container about two different but intersecting axes.

In another refinement, the suspension comprising titanium dioxide and silicone may be added first and used to coat a portion of the sidewall of the container followed by the adding of the suspensions comprising the colorants and the suspension comprising the talc.

In another refinement, the bottom and a portion of the sidewall of the container may be coated first with a suspension comprising one or more of talc, titanium dioxide and silicone to sufficiently coat the bottom and sidewalls of the container so as to prevent any suspension that includes colorants from coating or otherwise directly engaging the sidewall and bottom of the container prior to mixing.

In another refinement, all of the colorants may be mixed and provided in a single suspension.

In another refinement, the talc, titanium dioxide and silicone can be provided in separate suspensions or in a single suspension.

BRIEF DESCRIPTION OF THE DRAWINGS

The disclosed methods and apparatus will be described in greater detail with reference the accompanying drawings, wherein.

It should be understood that the drawings are not necessarily to scale and that the embodiments are illustrated with graphic symbols, phantom lines, diagrammatic representations and fragmentary views. In certain instances, detail which are not necessary for an understanding of the disclosed methods and apparatuses or which render other details difficult to perceive may have been omitted. It should be understood, of course, that the disclosed methods and apparatuses are not necessarily limited to the particular embodiments illustrated herein.

DETAILED DESCRIPTION OF THE PRESENTLY PREFERRED EMBODIMENTS

Figure 1:
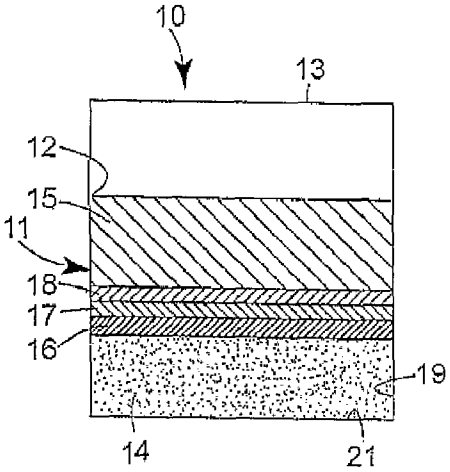
FIG. 1 is a front sectional view of a container with five suspensions deposited therein and covered by a lid prior to mixing in accordance with the disclosed methods.

A container 10 as shown in FIG. 1 which is intended to be used for containing cosmetics for purchase by an individual or consumer. The container 10 includes a container portion 11 having an open top 12 intended to be sealably covered by a lid 13. As noted above, a typical cosmetic preparation includes several different components. Typical ingredients include talc, titanium dioxide, silicone and one or more colorants. Numerous other types of ingredients may be included as well and the disclosed methods are not limited to the specific types of products discussed herein.

In the embodiment illustrated in FIG. 1, five different slurries are used for the cosmetic preparation. Those slurries include a base slurry 14, another base slurry 15 and slurries 16, 17, 18, all of which include colorants or other ingredients. The colorants or other ingredients may be provided in a single slurry as opposed to three different slurries 16, 17, 18 and the base slurries 14, 15 may be different or the same. For example, the base slurry 14 may be a talc slurry and the base slurry 15 may be a titanium dioxide and silicone slurry. Or the base slurries 14, 15 may be a mixture of talc, titanium dioxide and silicone, depending upon the product being prepared. Further, the order of the addition of the base slurries 14, 15 may be reversed. For example, the talc slurry 14 may be deposited first as shown in FIG. 1 or the titanium dioxide and silicone base slurry 15 may be deposited first.

By way of example, to prevent the slurries containing the colorants 16, 17, 18 from coating the bottom wall 21 and lower portions of the sidewall 19 of the container 11, either the slurry 14 containing talc or the slurry 15 containing titanium dioxide and silicone is deposited in the container portion 11 first. In the embodiment illustrated in FIG. 1, the slurry 14 containing talc is deposited so that the bottom wall 21 of the container portion 11 is coated with the slurry 14. This coating action prevents the slurries 16, 17, 18 containing the colorants from coating or adhering to the bottom wall 21 which is a severe hindrance to later mixing.

Therefore, in a preferred embodiment, a slurry 14 containing talc is deposited in the container portion 11 first. However, a slurry containing titanium dioxide or a slurry containing silicone or a slurry 15 containing both may be deposited first and preferably deposited in a manner so that the bottom wall 21 and the lower part of the sidewall 19 is coated with non-colorant slurry material. After the initial deposition of a non-colorant slurry, such as the slurry 14 containing talc, then the one or more slurries 16, 17, 18 containing one or more colorants such as red, black and yellow can be deposited on the first slurry 14. After the one or more slurries 16, 17, 18 are deposited on the first slurry 14, a second non-colorant containing slurry, such as the slurry 15 containing titanium dioxide and silicone is deposited on top of the entire mixture as shown in FIG. 1. Then, the lid 13 is secured to the container portion 11 and the product is ready for mixing.

Figure 2:
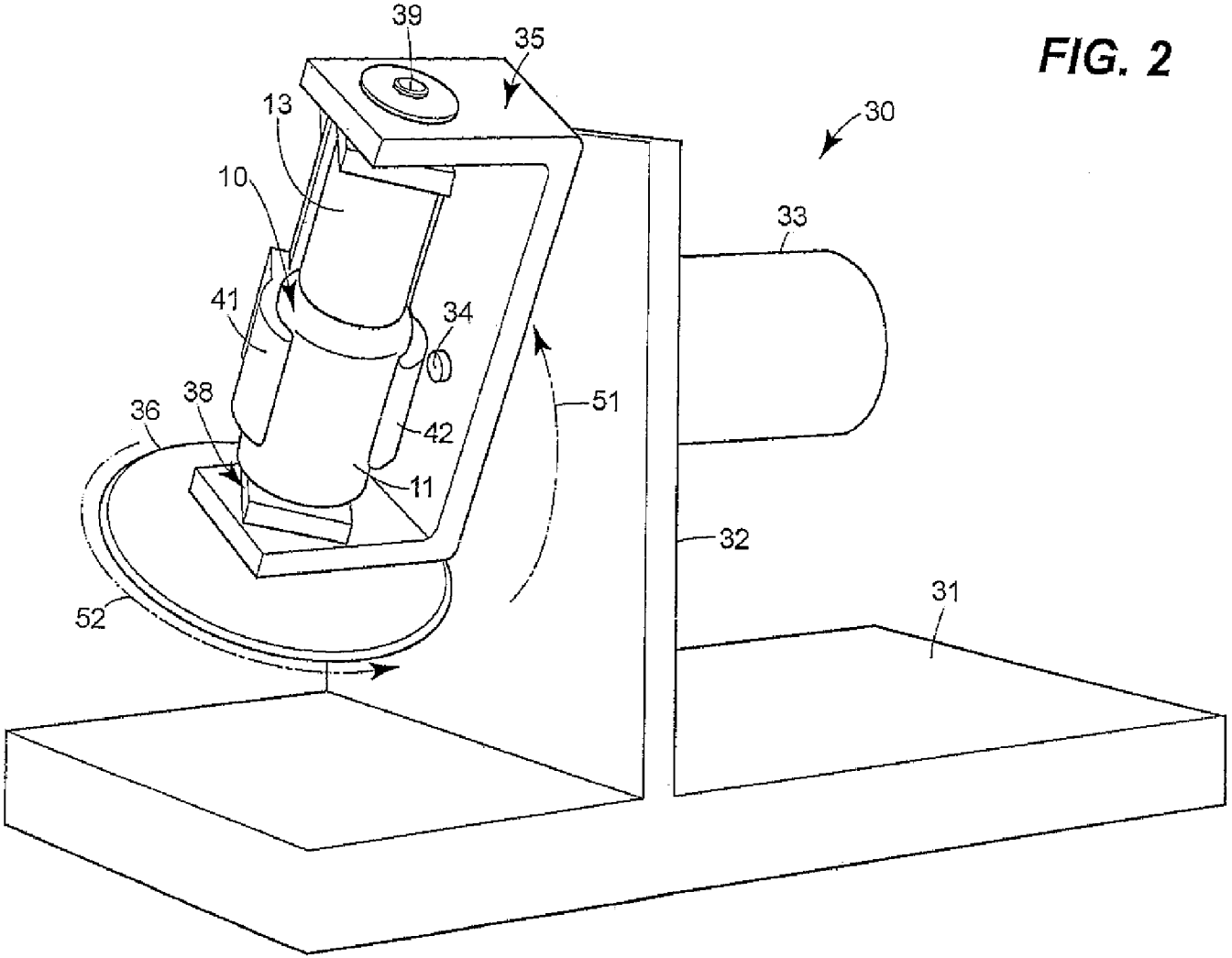
FIG. 2 is a perspective view of a gyroscopic mixer used to mix the suspensions disposed within the container shown in FIG. 1.
Figures 3, 4, 5:
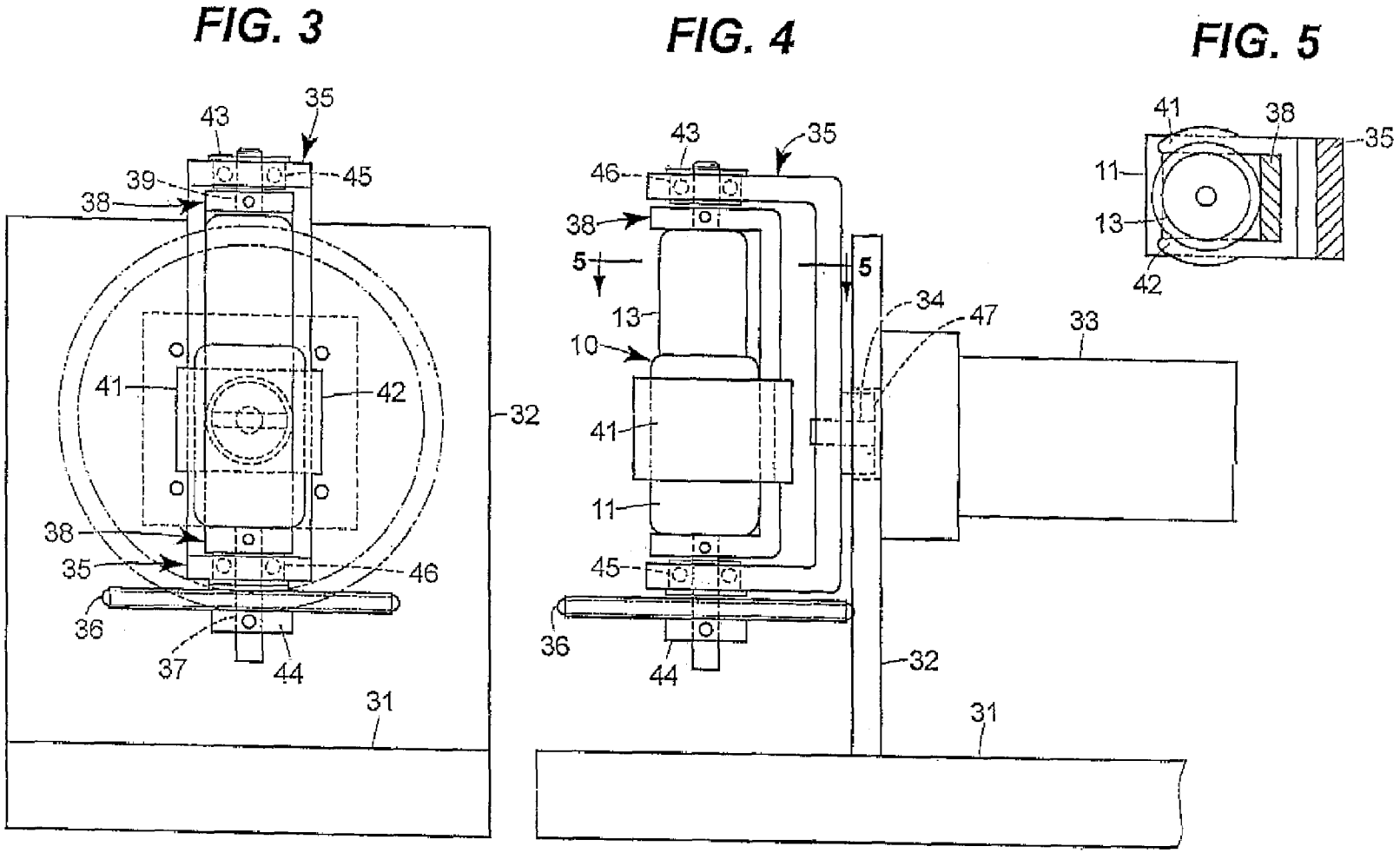
FIG. 3 is a front plan view of the gyroscopic mixer shown in FIG. 2.
FIG. 4 is a side plan view of the gyroscopic mixer shown in FIGS. 3 and 4.
FIG. 5 is a sectional view taken substantially along line 5—5 of FIG. 4.

FIG. 2 illustrates a suitable mixture for mixing custom made cosmetic preparations at a point of sale. The mixture 30 is a gyroscopic-type mixer that includes a base 31 connected to a vertical wall 32. A motor 33 is connected to one side of the wall 32 with a drive shaft 34 extending through the wall 32. A bracket 35 is mounted to the drive shaft 34. One end of the bracket 35 is rotatably connected to a wheel 36 by a shaft 37. The shaft 37 is fixably connected to an inner bracket 38 which serves as a supporting structure for the container 10. An opposite end of the bracket 38 is rotatably connected to an opposite end of the bracket 35 by another shaft 39 as shown in FIG. 3. The bracket 38 includes a pair of inwardly biased legs 41, 42 for securely holding the container 10 in place.

Referring to FIGS. 3 and 4, bushings 43, 44 are provided at either end of the bracket 35 to secure the shafts 37, 39 in place. Further, bushings 45, 46 are provided to permit rotation of the inner bracket 38 with respect to the outer bracket 35. As shown in FIG. 4, a bushing 47 is also provided for the drive shaft 34.

Returning to FIG. 2, rotation of the drive shaft 34 in the direction of the arrow 51 also results in rotation of the bracket 35 and container 10 in the direction of the arrow 51. However, with the wheel 36 engaging the wall 32, the wheel 36 also rotates in the direction of the arrow 52. Rotation of the wheel 36 and the direction of the arrow 52 also results in rotation of the inner bracket 38 and therefore the container 10 in the direction of the arrow 52. As a result, the container 10 is rotated about two different axes, one through the drive shaft 34 and the one through the shafts 37, 39 connecting the inner bracket 38 to the outer bracket 35. Thus, a gyroscopic motion is imparted to the container 10 which provides suitable mixing power to the various suspensions 14–18 shown in FIG. 1, all of which are relatively high viscosity, i.e., in the range of 10,000 cp or more.

Figure 7:
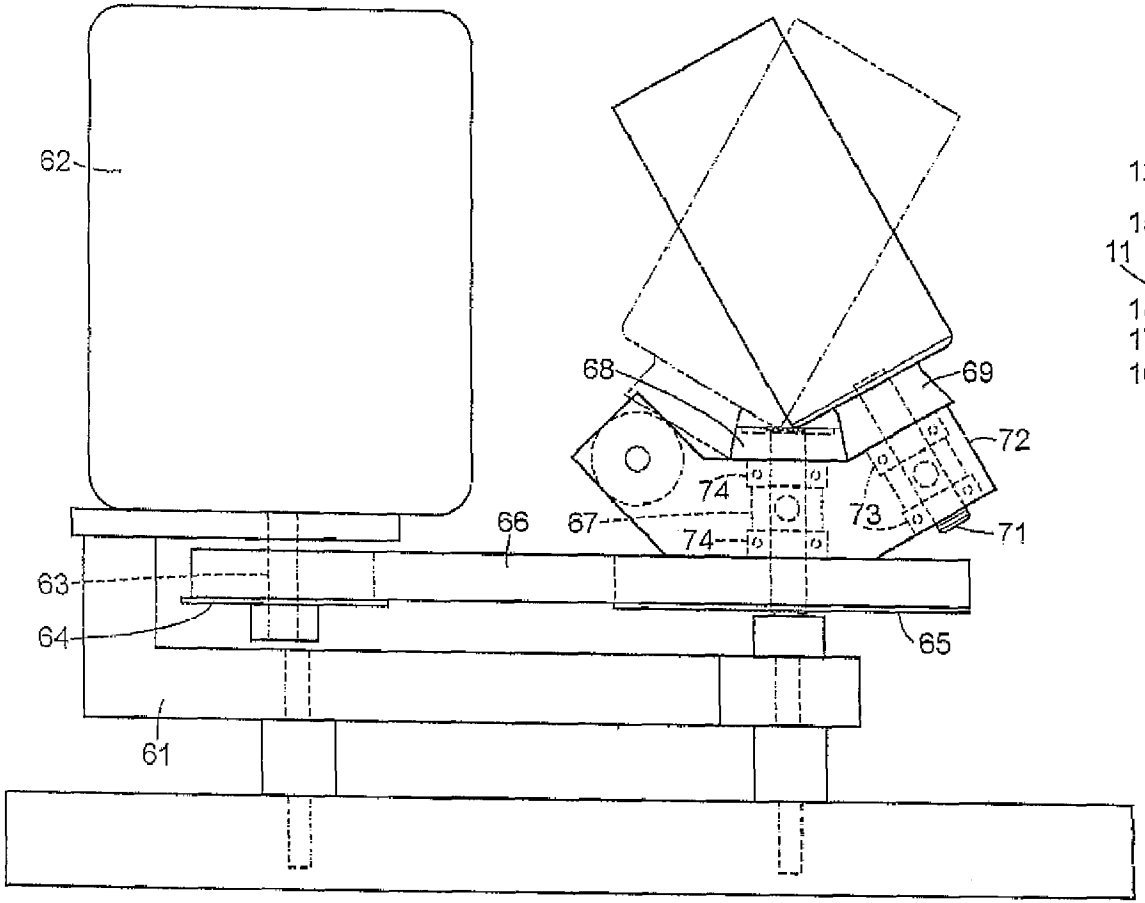
FIG. 7 is a side plan view of the mixer shown in FIG. 6.
Figure 6:
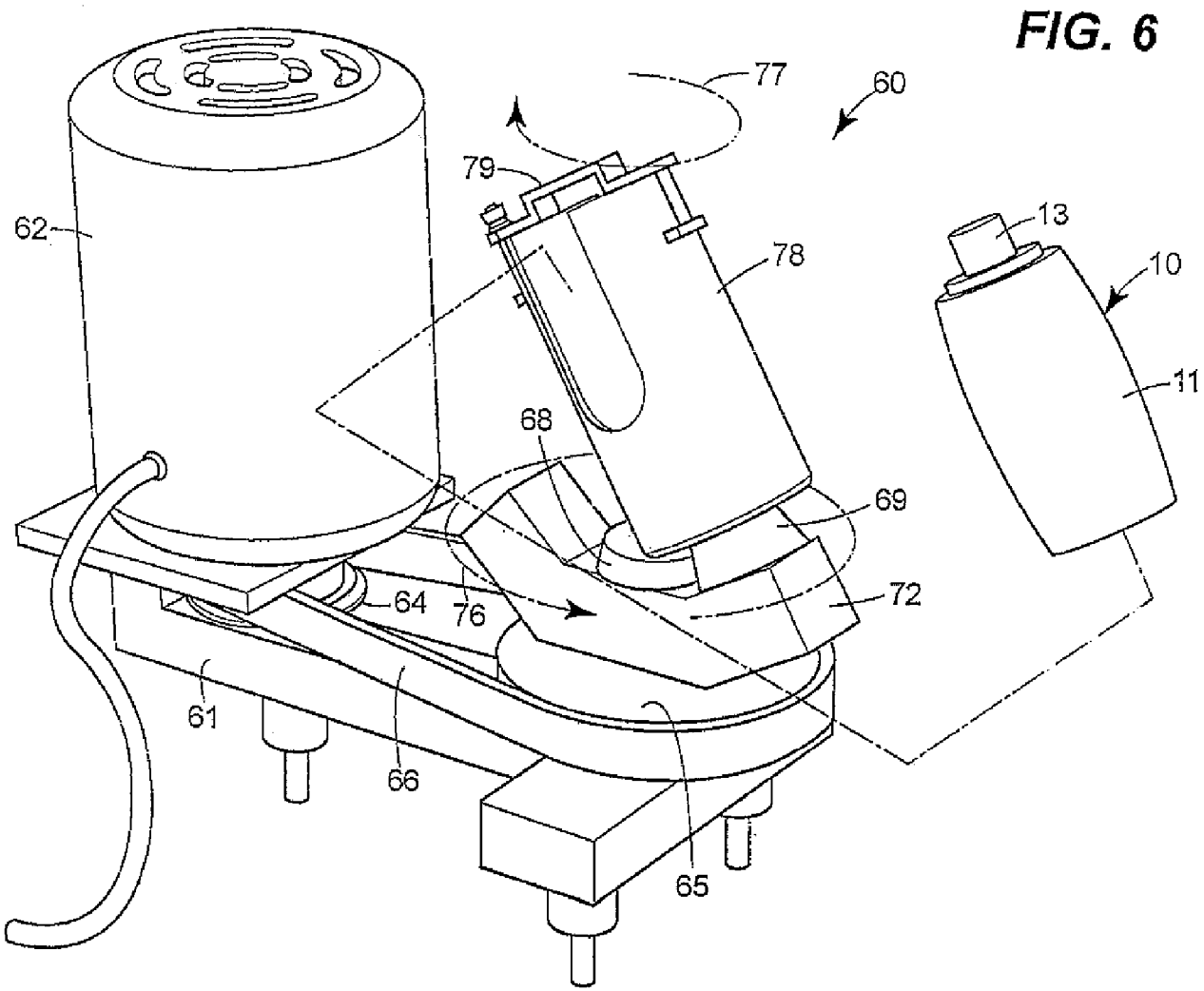
FIG. 6 is a perspective view of a rotary-type mixer used to mix the suspensions contained within the container of FIG. 1 in accordance with the disclosed methods.

FIGS. 6 and 7 illustrate another apparatus 60 for mixing the contents of a container 10. The mixer 60 of FIGS. 6 and 7 includes a base 61 which supports a motor 62. The motor 62 includes a drive shaft 63 connected to a pulley 64 (see FIG. 7). The pulley 64 is linked to a corresponding pulley 65 by the belt 66. The pulley 65 is connected to another shaft 67 which, at a distal end thereof is connected to a beveled gear 68. The beveled gear 68 is meshed with a corresponding beveled gear 69 which is connected to and supported by a shaft 71. The shaft 71 extends through the bracket 72 and is free to rotate by way of the supporting bearings shown in phantom at 73. Similarly, the shaft 67 is supported by the bushings shown in phantom at 74.

Returning to FIG. 6, rotation of the drive shaft 63 (FIG. 7) in the direction of the arrow 76 results in rotation of the pulleys 64, 65 in the same direction. The bracket 72 is connected to the pulley 65 and therefore the bracket 72 also rotates in the direction of the arrow 76. Because the pulley 65 is rotating in the direction of the arrow 76, the shaft 67 also rotates in the same direction which, results in rotation of the beveled gear 68 in the direction of the arrow 76 as well. However, the meshing engagement between the beveled gear 68 and the beveled gear 69 results in rotation of the beveled gear 69 in the direction of the arrow 77 as shown. The beveled gear 69 is secured to the bracket 78 which accommodates the container 10. The bracket 78 is equipped with a closure mechanism 79 to prevent dislodgement of the container 10 from the bracket or holder 78. Thus, rotation of the drive shaft 63 in the direction of the arrow 76 results in rotation of the entire assembly supported on the bracket 72 along the direction of the arrow 76. The beveled gear arrangement 68, 69 also results in an opposite rotation in the direction of the arrow 77. Thus, similar to the gyroscopic mixture 30 shown in FIGS. 2–5, the mixer 60 as shown in FIGS. 6-7 results in rotation of the container 10 along two different axes contemporaneously which results in an effective mixing of the numerous slurries to be mixed as discussed above with respect to FIG. 1.

Thus, in general, after the formulation of a cosmetic product is determined, a first base slurry is added to a container 10 which does not include colorant or other hard-to-mix ingredients. That initial slurry may include talc, silicone, titanium dioxide, any combination of two or three of these ingredients or other materials, depending upon the product to be prepared. A preferred embodiment is to initially deposit a first slurry 14 containing talc and the container, but it will be noted that the initial coating slurry may include just titanium dioxide, just silicone or any combination of silicone, titanium dioxide and talc. The initial slurry 14 deposited in the container 10 is used to coat the lower part of the sidewall 19 and bottom wall 21 of the container portion 11. This coating action prevents any slurry containing colorant from adhering to the lower part sidewall 19 or bottom wall 21. Then, one or more slurries 16–18 containing one or more colorants are added and one or more final slurries containing talc, titanium dioxide and silicone are added as a top slurry to form the suspension generally shown in FIG. 1. The slurries containing colorant 16–18 are disposed between slurries 14, 15 which do not contain colorant. The, the lid is secured to the container portion 11 and one or both of the mixers 30, 60 is utilized to thoroughly mix the ingredients to form a finished, customized product ready for sale. The method when used in conjunction with the apparatuses discussed above provides a fast and efficient way for preparing and selling customized cosmetic products.

Figure 8:
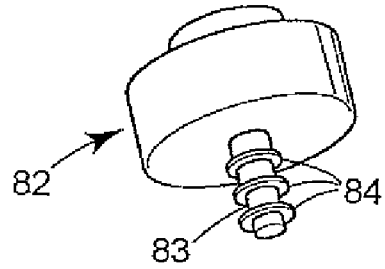
FIG. 8 is a perspective view of a plug used to temporarily close a container filled with material prior to mixing which prevents the material disposed in the container to be mixed from coating the narrow neck of the container.
Figure 9:
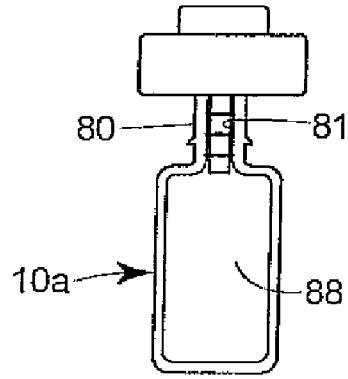
FIG. 9 is a front plan view of a container having a narrow neck fitted with the plug shown in FIG. 8.
Figure 10:
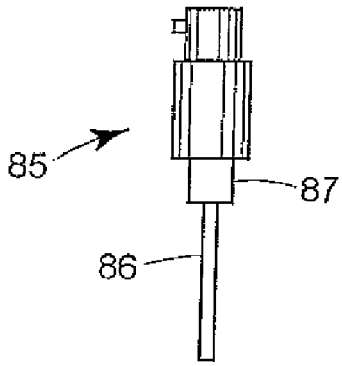
FIG. 10 is a front plan view of a pump used for a container having a narrow neck as shown in FIG. 9 wherein the inlet tube of the pump is equipped with a cylindrical plug which engages the inside surface of the narrow neck of a container, like the one shown in FIG. 9, and prevents materials contained within the container from coating the inside surface of the narrow neck during the mixing process.

Turning to FIGS. 8–10, another problem addressed by the disclosed methods involves the preparation of cosmetics products in containers having narrow necks, similar to the one shown in FIG. 6. Specifically, referring to FIG. 9, the container 10*a* includes a neck portion 80 that provides a narrow opening. If the ingredients of the product being made are allowed to engage the interior surface 81 of the narrow neck portion 80 of the container 10*a* during filling or mixing, those ingredients will almost be impossible to mix into the suspension thereby resulting in a streaking appearance at the neck 80 of the container 10*a* indicating to the consumer that the product is not thoroughly mixed. To avoid this problem, the plug 82 shown in FIG. 8 is provided which includes a stem 83 inserted downward into the neck 80 of the bottle 10*a*. The stem 83 may be equipped with one or more rings or washers 84 that not only to serve to wipe the inside surface of the neck 81 during insertion but also prevent materials from being splashed upward into the neck 80 during the subsequent mixing process.

After mixing, the plug 82 is removed in a conventional cap or pump 85, as shown in FIG. 10 is inserted downward through the neck 80. Referring to the pump 85 shown in FIG. 10, an alternative to the plug 82 shown in FIGS. 8-9 is disclosed. Specifically, the pump 85 includes an inlet tube 86. The inlet tube 86 is equipped with a cylindrical plug 87 that, similar to the plug 82, engages the neck 80 of the bottle 10*a* when the pump 85 is inserted therein. The plug 87 engages the neck 80 of the bottle 10*a*, wipes any material disposed thereon downward to the main portion 88 of the container, and prevents material from splashing upward onto the interior surface 81 of the neck during the subsequent mixing process. Thus, the plug 87 provides a means for installing the pump 85 into the bottle 10*a* prior to mixing.

While only certain embodiments have been set forth, alternative embodiments and various modifications will be apparent from the above description to those skilled in the art. These and other alternatives are considered equivalents and within the spirit and scope of this disclosure.

What is claimed is:

1. A method of mixing a cosmetic preparation at a point of sale, the method comprising:

a) providing a container comprising an open top, a bottom and a sidewall between the bottom and the top;

b) adding a first base suspension that is free of colorant other than titanium dioxide to the empty container thereby coating the bottom and at least a lower portion of the sidewall with the first base suspension;

c) adding one or more suspensions comprising one or more colorants on top of the first base suspension;

d) adding a second base suspension on top of the one or more suspensions comprising one or more colorants, the second base suspension also being free of colorant other than titanium dioxide;

e) closing the open top of the container with a lid after part (d) without adding any more suspensions containing colorants; and f) mixing the suspensions within the container by applying mechanical energy to the closed container.

2. The method of claim 1 wherein the container comprises a neck portion that terminates at the open top, and the closing of the open top of the container with a lid further comprises inserting a plug down into the neck of the container to prevent the suspensions from splashing upward into the neck during the mixing of the suspensions.

3. The method of claim 1 wherein the first base suspension comprises talc and the second base suspension comprises titanium dioxide and silicone either combined or in separate suspensions.

4. The method of claim 1 wherein the one or more suspensions comprising one or more colorants comprises a first suspension comprising a red colorant, a second suspension comprising a yellow colorant and a third suspension comprising a black colorant.

5. The method of claim 1 wherein the mixing by applying mechanical energy comprises the use of a gyroscopic mixer that rotates the closed container about two different but intersecting axes.

6. The method of claim 1 wherein the mixing by applying mechanical energy comprises the use of a rotary mixer that rotates the closed container about two different but intersecting axes.

7. A method of mixing a cosmetic preparation at a point of sale, the method comprising:

a) providing a container comprising a neck that terminates at an open top, a bottom and a sidewall between the bottom and the top;

b) adding a first base suspension to the container that is free of colorant other than titanium dioxide to the empty container thereby coating the bottom and at least a lower portion of the sidewall with the first base suspension;

c) adding a second suspension comprising one or more colorants on of the first suspension;

d) adding a third suspension comprising one or more colorants on top of the second suspension;

e) adding a fourth suspension comprising one or more colorants on top of the third suspension;

f) adding a fifth base suspension on top of the fourth suspension, the fifth base suspension being free of colorant other than titanium dioxide;

e) inserting a plug into the neck of the container to close the open top of the container after part (f) without adding any more suspensions containing colorants, the plug frictionally engaging the neck of the container and preventing the suspensions from splashing upward into the neck during the mixing of the suspensions; and f) mixing the suspensions within the container by applying mechanical energy to the closed container.

8. The method of claim 7 wherein the mixing by applying mechanical energy comprises the use of a gyroscopic mixer that rotates the closed container about two different but intersecting axes.

9. The method of claim 7 wherein the mixing by applying mechanical energy comprises the use of a rotary mixer that rotates the closed container about two different but intersecting axes.

10. A method of mixing a cosmetic preparation at a point of sale, the method comprising:

a) providing a container comprising a neck terminating in an open top and a bottom and a sidewall connecting the bottom to the neck;

b) adding a suspension comprising talc to the container and coating the sidewall and bottom with the suspension comprising talc, the suspension comprising talc being free of colorant other than titanium dioxide to the empty container thereby coating the bottom and at least a lower portion of the sidewall with the suspension;

c) adding one or more suspensions comprising one or more colorants including black, red and yellow colorants on top of the suspension comprising talc;

d) adding one or more suspensions comprising titanium oxide and silicone on top of the one or more suspensions comprising one or more colorants, the suspension comprising titanium dioxide being free of colorant other than titanium dioxide;

e) closing the open top of the container by inserting a plug into the neck of the container after part (d) without adding any more suspensions containing colorant, the plug frictionally engaging the neck of the container and preventing the suspensions from splashing upward into the neck during the mixing of the suspensions; and f) mixing the suspensions within the container by applying mechanical energy to the closed container.

11. The method of claim 10 wherein the mixing by applying mechanical energy comprises the use of a gyroscopic mixer that rotates the closed container about two different but intersecting axes.

12. The method of claim 10 wherein the mixing by applying mechanical energy comprises the use of a rotary mixer that rotates the closed container about two different but intersecting axes.

13. A method of mixing a cosmetic preparation at a point of sale, the method comprising:

a) providing a container comprising an open top, a bottom and a sidewall between the bottom and the top;

b) adding a suspension comprising one or more of talc, titanium oxide and silicone to the container, said suspension being free of colorant other than titanium dioxide to the empty container thereby coating the bottom and at least a lower portion of the sidewall with the first base suspension;

c) adding one or more suspensions comprising one or more colorants on top of the suspension comprising one or more of talc, titanium oxide and silicone;

d) adding another suspension comprising one or more of titanium oxide, silicone and talc on top of the one or more suspensions comprising one or more coolants said another suspension being free of colorant other than titanium dioxide;

e) closing the open top of the container with a lid after part (d) without adding any more suspensions containing colorants; and f) mixing the suspensions within the container by applying mechanical energy to the closed container.

14. The method of claim 13 wherein the one or more suspensions comprising one or more colorants comprises a first suspension comprising a red colorant, a second suspension comprising a yellow colorant and a third suspension comprising a black colorant.

15. The method of claim 13 wherein the mixing by applying mechanical energy comprises the use of a gyroscopic mixer that rotates the closed container about two different but intersecting axes.

16. The method of claim 13 wherein the mixing by applying mechanical energy comprises the use of a rotary mixer that rotates the closed container about two different but intersecting axes.

* * * * *